US009376178B2

(12) United States Patent
Suckewer

(10) Patent No.: US 9,376,178 B2
(45) Date of Patent: Jun. 28, 2016

(54) CROSS-WATER SKIS

(71) Applicant: Szymon Suckewer, Princeton, NJ (US)

(72) Inventor: Szymon Suckewer, Princeton, NJ (US)

( * ) Notice: Subject to any disclaimer, the term of this patent is extended or adjusted under 35 U.S.C. 154(b) by 53 days.

(21) Appl. No.: 14/318,622

(22) Filed: Jun. 28, 2014

(65) Prior Publication Data

US 2015/0004857 A1 Jan. 1, 2015

Related U.S. Application Data

(60) Provisional application No. 61/838,691, filed on Jun. 24, 2013.

(51) Int. Cl.

| | |
|---|---|
| ***B63B 35/81*** | (2006.01) |
| ***B63B 35/85*** | (2006.01) |
| ***B63B 35/83*** | (2006.01) |
| *B63H 16/04* | (2006.01) |

(52) U.S. Cl.

CPC ..... *B63B 35/81* (2013.01); *B63B 35/83* (2013.01); *B63B 35/85* (2013.01); *B63H 16/04* (2013.01)

(58) Field of Classification Search

CPC ..... B63B 35/83; B63B 35/81; B63H 16/08
USPC ..... 441/65, 66, 67, 75, 76, 77, 79; 440/101, 440/102

See application file for complete search history.

(56) References Cited

U.S. PATENT DOCUMENTS

| | | | | |
|---|---|---|---|---|
| 1,719,059 | A | 7/1928 | Krupka | |
| 3,084,356 | A * | 4/1963 | Wheat | B63B 35/83 237/12.3 A |
| 3,936,897 | A | 2/1976 | Schaumann | |
| 4,060,866 | A * | 12/1977 | Robinson | B63B 1/12 441/76 |
| 4,713,032 | A * | 12/1987 | Frank | B29C 37/0032 264/250 |
| 5,236,381 | A * | 8/1993 | Keogh | B63B 35/83 441/77 |
| 6,855,024 | B2 * | 2/2005 | Rothschild | B63H 16/08 441/77 |
| 7,462,083 | B2 | 12/2008 | Ambrico | |
| 7,607,959 | B2 * | 10/2009 | DeMint | B63B 35/83 440/21 |
| 8,075,358 | B2 | 12/2011 | Yesil et al. | |

* cited by examiner

*Primary Examiner* — Andrew Polay
(74) *Attorney, Agent, or Firm* — r.r (princeton); Roy Rosser

(57) ABSTRACT

A device for traversing water is disclosed that has a left and a right-foot hull and a pair of propulsion poles with attached propulsion pontoons. The propulsion poles are shaped and sized so that a person standing upright can use them to propel themselves across water. The underside of each hull has kick-forward plates that allow the hull to move unimpeded in one direction but not the other. A rail is connected near the inner edge of one hull, and a the rail follower fixed to the other hull, and slidably connected to the rail allow the hulls to more relative to each other in a direction parallel to their long axis.

5 Claims, 3 Drawing Sheets

CROSS-WATER SKIS

CLAIM OF PRIORITY

This application claims priority to U.S. Provisional Patent Application 61/838,691 filed on Jun. 24, 2013, the contents of which are hereby incorporated by reference in their entirety.

FIELD OF THE INVENTION

The invention relates to aquatic devices, and more particularly to a device to enable a person to ski over water while standing upright, in a manner analogous to a cross-country skier, but on water.

BACKGROUND OF THE INVENTION

Devices for "walking on water" have a long history, with possibly the earliest documented example being Leonardo da Vinci's 1480 sketch of a man walking on water using elongated floats, preserved on sheet 28 of the Codex Atlanticus, now at the Museo Nazionale della Scienza e della Tecnologia in Milan, Italy.

Devices for "skiing on water" do not have quite such a long history, and have never become commercially available. One possible reason may be that no materials were available to provide a sufficiently buoyant and stable platform that was also light and relatively compact. Even the polyurethane foam and polyester resin surfboards developed in the second half of the $20^{th}$ century would have required relatively unwieldy pontoons in order to-support a 250 lb. person. In the last decade, however, the ability to produce suitable shapes using expanded polystyrene (EPS) foam coated with epoxy resins, has resulted in even lighter and more buoyant surfing structures.

An early prototype of the present invention was constructed by modifying such an EPS-epoxy constructed windsurfing board. The windsurfing board, capable of carrying 250 lbs., was cut in half along the long axis to create a pair of water skis. A foot holding device was attached on the top surface of each "water-ski" at a position near the center-of-floatation, allowing a person to stand on the two water-skis in a stable, upright position.

Various embodiments of this invention are illustrated in the accompanying drawings and will be described in more detail herein below.

SUMMARY OF THE INVENTION

An inventive system and method of device for traversing water is disclosed.

In a preferred embodiment, the device may have a left and a right-foot hull. Each of the hulls may have a substantially flat top surface, and a length that is several times the width of the hull 125, the actual ratio of length to width being dependent, to a large degree, on the required hull floatation value.

The hulls may, for instance, be constructed using a suitable combination of materials such as, but not limited to, having an expanded polystyrene core covered by an epoxy skin. The size, shape and materials of each hull may be such that each of them provides floatation on water sufficient to support an approximately 50-75 lb. weight, and more preferably about 125 lb.

The device for traversing water may also include a left and a right-hand propulsion pole. In a preferred embodiment, each propulsion pole may have a propulsion pontoon attached to a rod. The propulsion pontoon may be constructed so as to support about a 10-50 lb. weight when floating on water. The propulsion pontoon may further be and shaped and sized to be used by a person standing upright with one foot removably attached to each of the hulls, and holding the propulsion poles in a vicinity of their top ends. The propulsion pole may, for instance, be used to produce sufficient forward thrust to propel a user laterally across the surface of a body of water.

In a preferred embodiment of the present invention, the device for traversing water may further include one or more "kick-forward plates". These may, for instance, be substantially square sheets of a suitable material such as, but not limited to, wood, plastic, aluminum, stainless steel or brass or some combination thereof, that may be connected the underside of a hull so as to allow the hull to move unimpeded relative to the water's surface in one direction, but not in the opposite direction.

In a further preferred embodiment of the invention, the device for traversing water may further include a combination of a rail and a rail follower. The rail may, for instance, be connected near to the inner edge of the right foot hull, while the rail follower may be fixed at a one end to left-foot hull, and slidably connected to the rail or directly to the surface of the-other hull. This combination may, for instance, allow the hulls to more relative to each other only in a direction parallel to their long axis. The device for traversing water may include two or more such rails and connectors to other hull surface or rail follower combinations.

Therefore, the present invention succeeds in conferring the following, and others not mentioned, desirable and useful benefits and objectives.

It is an object of the present invention to provide a relatively inexpensive means of "skiing on water".

It is another object of the present invention to provide exercise equipment for use on lakes, ponds, oceans, bays, and so on.

BRIEF DESCRIPTION OF THE DRAWINGS

FIG. 3 B shows a side view of a floatation hull in a preferred embodiment of the present invention.

FIG. 4 B shows a side view of a floatation hull in a further preferred embodiment of the present invention.

DESCRIPTION OF THE PREFERRED EMBODIMENTS

Figure 1:
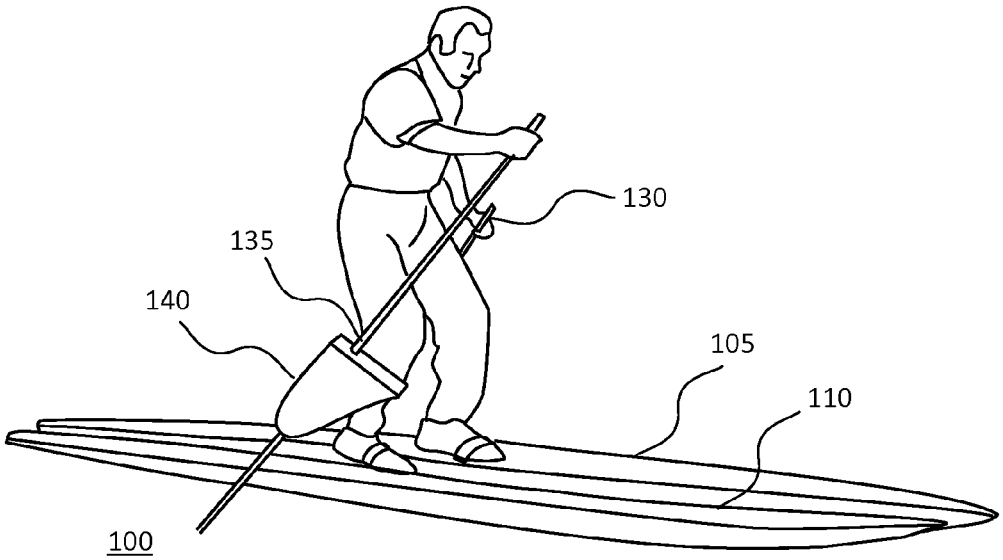
FIG. 1 shows a person using a device for traversing water of the present invention.

The preferred embodiments of the present invention will now be described with reference to the drawings. Identical elements in the various figures are identified with the same reference numerals.

Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 shows a person using a device for traversing water of the present invention 100. The person is shown standing with one foot removably attached to a left-foot hull 105 and the other to a right-foot hull 110. The person may, for instance, be using a left-hand propulsion pole 130 and a right-hand propulsion pole 135 to both balance and to propel themselves laterally forward across a body of water. The propulsion poles 130/135 may each include a propulsion pontoon 140 to aid in the balancing and in the propulsion.

Figure 2:
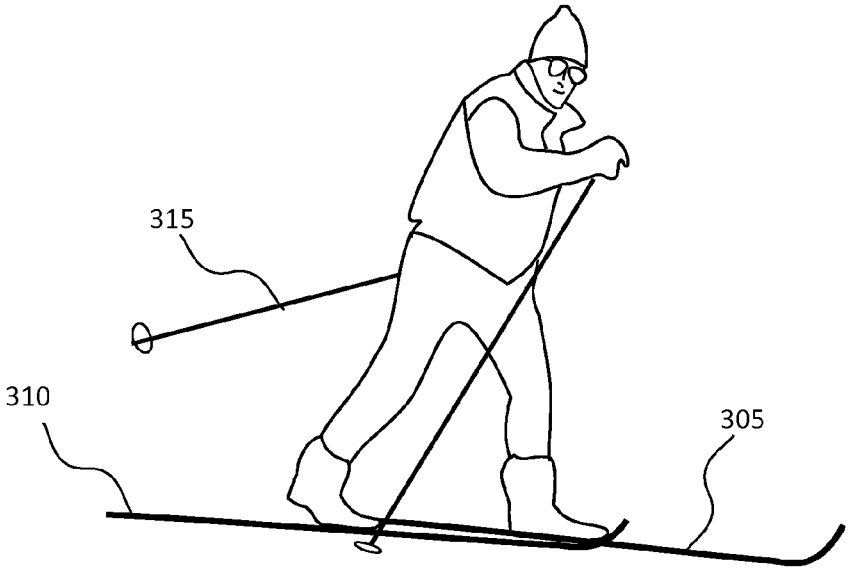
FIG. 2 shows a person using a pair of cross-country skis.

FIG. 2 shows a person using a pair of cross-country skis in order to demonstrate the analogy with the "water skis" of the present invention, shown in FIG. 1. The person has one foot removably attached to the left-foot cross-country ski 305 and the other to the right-foot cross-country ski 310. The person also has a pair of cross-country skiing pole 315 that may be used to aid in forward propulsion.

Figure 3A:
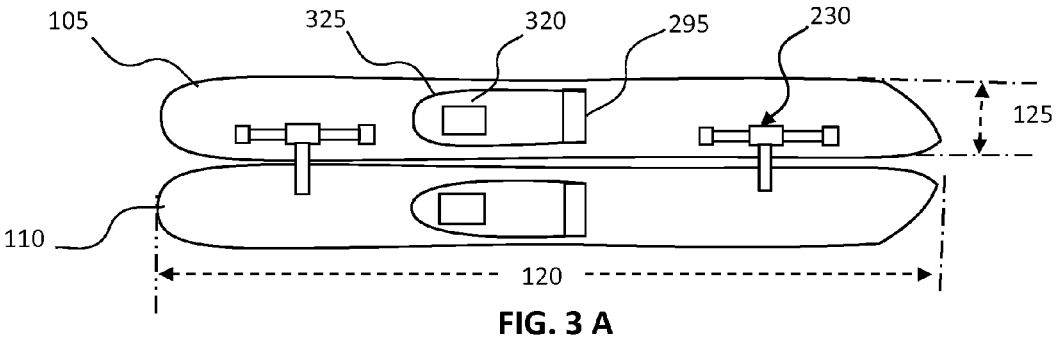
FIG. 3 A shows a plan view of a pair of floatation hulls in a preferred embodiment of the present invention.
Figure 3B:
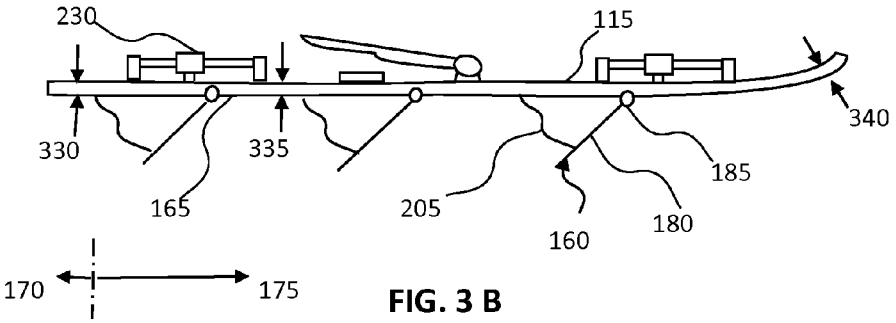

FIG. 3 A shows a plan view, and FIG. 3 B shows a side view, of a pair of floatation hulls in a preferred embodiment of the present invention.

The left-foot hull 105 and the right-foot hull 110 are mirrored versions of each other, and both may have a substantially flat top surface 115 and a length 120 that may be several times the width of the hull 125, where the ratio of length to width of the hull depends, in part, on the required hull floatation value.

The hulls may, for instance, be constructed using a suitable combination of materials such as, but not limited to, having an expanded polystyrene (EPS) foam core covered by an epoxy skin. The size, shape and materials of each hull may be such that each hull may provide floatation on water sufficient to support an approximately 50-75 lb. weight, and more preferably about 125 lb. Other technologies used in, for instance, the manufacture of wind and water surfing boards and stand up paddleboards (SUP) may also be used, though their buoyancy may influence the compactness of designs made using them. Those technologies include, but are not limited to, polyurethane foam and polyester resin, fiber glass, carbon fiber, honeycomb aluminum, wood, or a combination thereof.

As shown in FIG. 3 B one or more kick-forward plates 160 may be attached to the underside 165 of each hull. These kick-forward plates 160 may, for instance, be structures that impede motion relative to the surface of water in one direction 170 but not in an opposite direction 175. The kick-forward plate 160 may, for instance, include a flat plate 180 that may be connected to the underside 165 of a hull by a hinge joint 185. The kick-forward plate 160 may also include a length of flexible chord 205 that may allow the plate 180 to rotate to be parallel with the substantially flat top surface 115 when moved in one direction, but may be limited to being nearly vertical when the hull is being moved in the other direction. This arrangement may, for instance, allow someone using the device for traversing water 100 to move forward using a shuffling type motion, similar to the motion that may be used when cross-country, snow skiing.

Each hull may have a toe-of-foot holding strap 295 attached to the top surface 115, as well as a heel plate 320 and a foot restraint 325. The heel plate 320 and the toe-of-foot holding strap 295 may be positioned so as to allow a center of gravity of a user to be located over a center of floatation of one or other of the hulls, or the center of floatation of the combination of the hulls. The foot restraint 325 may, for instance, be a loop of elastic that may help maintain a foot in the correct position.

In a preferred embodiment, the length of the hulls 120 may be in a range of 350 to 450 cm, and in a more preferred embodiment, the length of said hull 120 may in a range of 375 to 385 cm, and in a most preferred embodiment, the length may be approximately 380 cm.

The width of the hulls 125 may, in a preferred embodiment of the present invention, be in a range of 20 to 40 cm, and in a more preferred embodiment may be approximately 30 cm.

In a preferred embodiment, the aft thickness 330 and the forward thickness 340 of each hull may be in a range of 5 to 15 cm, and in a more preferred embodiment, these thicknesses may be approximately 10 cm.

In a preferred embodiment, a mid-thickness 335 of each hull may be in a range of 20 to 40 cm and in a more preferred embodiment the mid-thickness 335 may be approximately 30 cm.

Figure 4A:
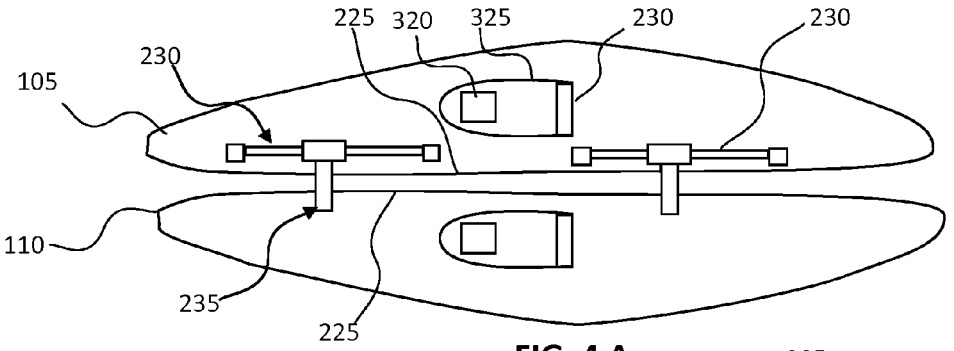
FIG. 4 A shows a plan view of a pair of floatation hulls in a further preferred embodiment of the present invention.
Figure 4B:
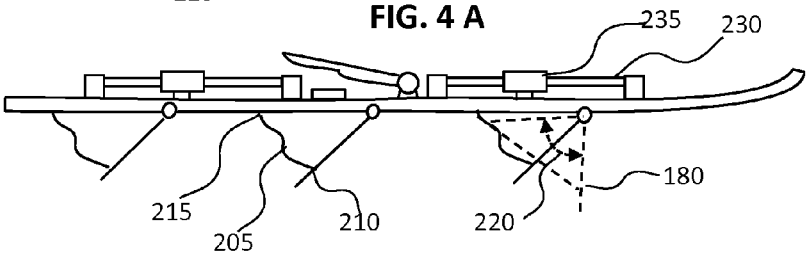

FIG. 4 A shows a plan view, and FIG. 4 B shows a side view, of a pair of floatation hulls in a further preferred embodiment of the present invention.

As shown in FIGS. 3 A and 3 B, the device for traversing water 100 may further include a rail 230 and a rail follower 235.

In a further preferred embodiment of the present invention, the rail 230 may, for instance, be a length of material having a constant cross section and may be attached to a left-foot hull 105, such that it may be parallel to an inner edge 225 of the hull and to the surface of the water, when in use. The rail follower 235 may, for instance, be attached to the other hull, i.e., in this example to the right-foot hull 110 and have a protruding portion that may be a sliding fit to the rail. In this way, the two hulls may be free to be moved parallel to each other but not to be separated laterally by more than the distance allowed by the rail 230 and the rail follower 235.

In a preferred embodiment, the rail 230 may be a rod or cylinder made of a suitable material such as, but not limited to, aluminum, plastic or stainless steel or a combination thereof.

In a preferred embodiment of the present invention, there may be two pairs of rail 230 and rail follower 235, one of which may be positioned towards the front of the hulls and the other toward the rear of the hulls.

FIGS. 4 A and 4 B show a plan view and a side view, respectively, of a pair of floatation hulls in a further preferred embodiment of the present invention.

As shown in FIG. 4 A the outer edge of the hull may be curved to allow greater buoyancy in a central region of the hull.

FIG. 4 B also shows a kick-forward plate 160 in which, in a preferred embodiment of the present invention, the retarding element is a flat, substantially square and flat stainless steel plate 180. The plate 180 may instead be made of any suitable material that is sufficiently strong, rigid and water resistant such as, but not limited to, brass, galvanized steel, wood or EPS coated with epoxy or some combination thereof.

The flat, substantially square and flat stainless steel plate 180 may be tethered to the hull by a length of flexible chord 205 that may, for instance, be nylon, or any other suitably strong, water resistant and flexible chord such as, but not limited to, string, rope, thin copper wire, elastic or some combination thereof. Although the hinge joint 185 may allow the plate 180 to rotate freely about an axis that may be orthogonal to both the plane of the water surface and to a long axis of the hull, the length of flexible chord 205 may restrain the plate to only rotate through a range of motion 220 that is approximately 90 degrees. The range of motion 220 may, for instance, be from nearly parallel to the flat top surface of the hull to perpendicular to the surface of the water, when in use.

Figure 5:
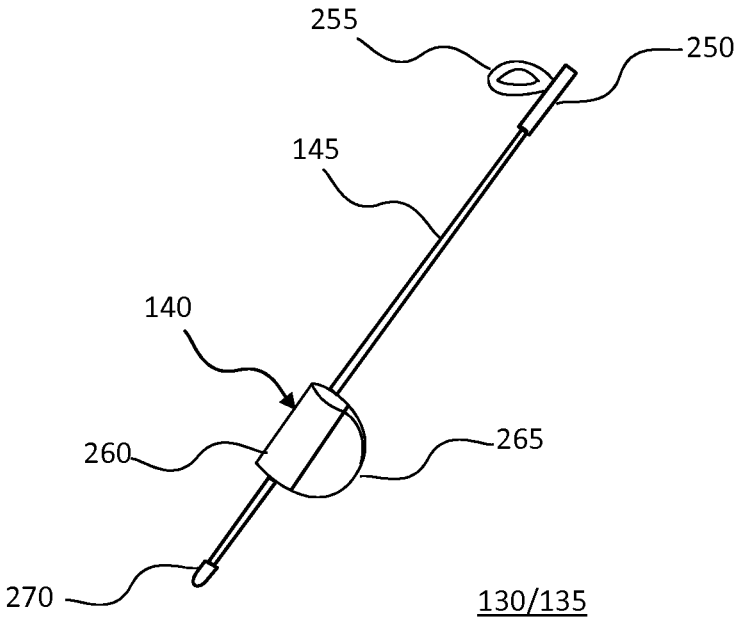
FIG. 5 shows a propulsion pole of a preferred embodiment of the present invention.

FIG. 5 shows a propulsion pole of a preferred embodiment of the present invention.

The propulsion poles 130/135 may have a rod 145 with a fixedly connected propulsion pontoon 140. The propulsion pontoon 140 may, for instance, be made of a suitably buoyant yet tough and water resistant material such as, but not limited to, EPS with an epoxy skin, wood, plastic, or some combination thereof.

The propulsion pontoon 140 may, for instance, have a tubular section 260 and a fin section 265 that may, for instance, be used to assist in steering and/or propulsion.

The propulsion pole may also have a handle 250, a hand strap 255 and an end element 270.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A device for traversing water, comprising:

a left-foot hull and a right-foot hull, each hull having a substantially flat top surface, and a length of said hull that is at least three times a width of said hull, and wherein each of said hulls has sufficient floatation on water to support at least a 50 lb. weight;

a right-foot rail connected to said right-foot hull on a top surface of said right-foot hull, said rail being oriented to be substantially horizontal and parallel to said inner edge;

a rail follower, said rail follower being fixed to a substantially flat top-surface of said left-foot hull, and slidably connected to said right-foot rail at a second end of said rail follower; and a left-hand propulsion pole and a right-hand propulsion pole, each propulsion pole comprising a propulsion pontoon fixedly attached to a rod, said propulsion pontoon having sufficient floatation on water to support at least a 10 lb. weight, and shaped and sized to be used by a person standing with one foot removably attached to each of said hulls and holding said propulsion poles in a vicinity of a top end of said rod, to produce sufficient forward thrust to propel said person and said hulls laterally across a surface of a body of water.

2. The device of claim 1 further incorporating at least one kick-forward plate hingedly attached to an underside of each hull such that motion relative to a surface of said water is impeded in one direction but not in an opposite direction.

3. The device of claim 2 wherein said kick-forward plate is a plate rotatable connected to said underside one of said hulls by a hinge joint so as to be able to swing about a hinge axis that is orthogonal to the vertical and to a long axis of said hull, and further comprises a length of flexible chord, a first end of said cord being connected to said kick-forward plate near to the edge opposite the edge that is hingedly connected, and a second end of said cord is fixed to said underside of each hull such that said plate is limited to a range of motion of approximately 90 degrees from a vertical to being substantially parallel to said substantially flat top surface.

4. The device of claim 1 wherein said rail is a stainless steel or aluminum rod and wherein said plate is a flat, substantially square, stainless steel or aluminum plate.

5. The device of claim 1 wherein said hulls comprise an expanded polystyrene core and an epoxy skin.

* * * * *